US005173678A

United States Patent [19]

Bellows et al.

[11] Patent Number: 5,173,678

[45] Date of Patent: Dec. 22, 1992

[54] FORMED-TO-SHAPE SUPERCONDUCTING COIL

[75] Inventors: Alfred H. Bellows, Wayland; Mark Levinson, Sudbury, both of Mass.

[73] Assignee: GTE Laboratories Incorporated, Waltham, Mass.

[21] Appl. No.: 580,396

[22] Filed: Sep. 10, 1990

[51] Int. Cl.[5] ..... H01F 1/00

[52] U.S. Cl. ..... 335/216; 335/299; 29/606; 505/1; 505/879

[58] Field of Search ..... 335/299, 300, 216; 505/924, 879, 1; 29/605, 606, 599

[56] References Cited

U.S. PATENT DOCUMENTS

| | | | |
|---|---|---|---|
| 3,333,331 | 8/1967 | Swartz | 505/924 X |
| 3,528,172 | 9/1970 | Smulkowski | 505/924 X |
| 3,733,692 | 5/1973 | Fietz | 29/599 |
| 4,891,355 | 1/1990 | Hayashi | 505/1 |
| 4,933,318 | 6/1990 | Heijman | 505/1 |
| 5,011,823 | 4/1991 | Jin et al. | 505/1 |
| 5,015,618 | 5/1991 | Levinson | 505/1 |

FOREIGN PATENT DOCUMENTS

| | | | |
|---|---|---|---|
| 285106A | 10/1988 | European Pat. Off. . | |
| 59-222464B4 | 12/1984 | Japan | 335/216 |
| 63-207009 | 8/1988 | Japan . | |

OTHER PUBLICATIONS

S. Jin et al., "High Critical Currents in Y-Ba-Cu-O Superconductors", *Appl. Phys. Lett.* 52 (24), pp. 2074-2076, 13 Jun. 1988.

I. N. Miaoulis et al., "Zone Melting Processing of Thick High-$T_c$ Superconducting Films", *J. Phys. D: Appl. Phys* 22, pp. 864-867, 1989.

H. D. Brody et al., "Highly Textured Single Crystal $Bi_2CaSr_2Cu_2O_x$ Prepared by Laser Heated Float Zone Crystallization," J. Cryst. Growth 96, pp. 225-233 (1989).

J. S. Haggerty et al., "Growth of Crystalline Superconducting Oxides from Float Zones Melts," presented American Ceramic Soc. Mtg. 25 Apr. 1989.

G. Lu et al., "Directional Solidification of $YBa_2Cu_3O_7$," presented American Ceramic Soc. Mtg. 26 Apr. 1989.

M. Levinson et al., "Laser Zone-Melted Bi-Sr-Ca-Cu-O Thick Films," *Appl. Phys. Lett.* 55 (16), pp. 1683-1685, 16 Oct. 1989.

*Primary Examiner*—Leo P. Picard
*Assistant Examiner*—Trinidad Korka
*Attorney, Agent, or Firm*—Frances P. Craig

[57] ABSTRACT

A superconducting coil assembly. The assembly includes an insulating substrate, a plurality of insulating layers disposed in a stacked assembly on the substract, and a superconducting spiral pattern between the substrate and the adjacent insulating layer and between each adjacent pair of insulating layers. Superconducting connecting portions connect the spiral patterns to form a continuous thick film superconducting coil of right hand or left hand orientation. The spiral patterns and connecting portions are thick films of a high temperature ceramic superconducting material. A superconducting connecting link may interconnect the ends of the continuous coil to form a closed loop. The insulating layers and spiral patterns may be deposited successively over an insulating substrate. Alternatively, the insulating layers may be annular disks with vias therethrough for connecting the spiral patterns. Preferably, the cross-sectional area of each coil portion varies inversely with its radius to effect a constant critical current capacity throughout each coil portion. A method for producing the coil assembly is also disclosed.

20 Claims, 3 Drawing Sheets

FORMED-TO-SHAPE SUPERCONDUCTING COIL

BACKGROUND OF THE INVENTION

This invention relates to high temperature ceramic superconductors, and in particular to coils of such superconducting materials useful in such devices as electromagnets.

Much attention has been paid to making high temperature superconducting "wires" amenable to use of conventional winding techniques to make coils for solenoids and motors. Success in fabricating such wires with acceptable critical current density, $J_c$, has, however, been limited. On the other hand, thin films can be made with excellent $J_c$ when grown epitaxially on certain substrates. Such film coated substrates, however, are difficult to make and handle and cannot be shaped into coils after fabrication. Moreover, thick films are preferred for many applications because of their larger cross sectional areas, and the resulting larger potential total current carrying capacity. The present application describes a thick film alternative to prior art superconducting coils.

SUMMARY OF THE INVENTION

In one aspect, the invention disclosed herein is a superconducting coil assembly including an insulating substrate, a plurality of insulating layers disposed in a stacked assembly on the substrate, a plurality of superconducting coil portions, and superconducting connecting portions connecting the coil portions. The superconducting coil portions each consist essentially of a thick film of a high temperature ceramic superconducting material, and each has a first end and a second end. A first coil portion is disposed between the substrate and the insulating layer adjacent thereto and the remainder of the coil portions are each disposed between adjacent pairs of the insulating layers. The superconducting connecting portions, each consisting essentially of a thick film of the same superconducting material as that of the coil portions, connect each of the coil portion first ends except that of the first coil portion to the second end of an adjacent coil portion so that the plurality of coil portions are joined by the connecting portions to form a continuous thick film superconducting coil of right hand or left hand orientation.

(As used herein, the term "the same superconducting material" is intended to include not only identical materials, but also closely related superconducting materials having the same elemental components, but varying in stoichiometry, phase, etc., as well as those including a minor amount of a dopant material, for example a bismuth-lead strontium calcium copper oxide superconductor used with a bismuth strontium calcium copper oxide superconductor.)

In another aspect, the invention is a superconducting coil assembly comprising an insulating substrate having a first contact means, a plurality of insulating layers disposed in a stacked assembly on the substrate, a plurality of superconducting coil portions, superconducting connecting portions connecting each of the coil portions, a second contact means connected to the uppermost coil portion, and a superconducting connecting link interconnecting the first contact means and the second contact means. Each of the insulating layers is in the form of an annular disk having a central opening, an outer edge, and a via therethrough. The vias of successive insulating layers are disposed alternately near the outer edge and near the central opening of the insulating layers. Each superconducting coil portion consists essentially of a thick film of a high temperature ceramic superconducting material and has a first end and a second end. A first coil portion is disposed between the substrate and the insulating layer adjacent thereto. The remainder of the coil portions are each disposed between adjacent pairs of the insulating layers. Each coil portion is a spiral pattern of at least one winding extending between the vias of the insulating layers above and below the coil portion, or in the case of the first coil portion, between the via of the insulating layer above the first coil portion and the first contact means. Inwardly spiralling coil portions alternate with outwardly spiralling coil portions. Each superconducting connecting portion consists essentially of a thick film of the same superconducting material as that of the coil portions. A superconducting connecting portion is disposed at each of the vias and connects each of the first ends except that of the first coil portion to the second end of an adjacent coil portion so that the plurality of coil portions are joined by the connecting portions to form a continuous superconducting coil of right hand or left hand orientation. The superconducting connecting link consists essentially of a thick film of the same superconducting material as that of the coil portions. The link interconnects the first contact means and the second contact means to form a closed loop with the continuous superconducting coil, such that current initially introduced to the coil continuously flows within the closed loop with no resistance when the coil is cooled to an appropriate temperature.

In a narrower aspect, the cross-sectional area of each coil portion varies inversely with its radius to effect a constant critical current capacity throughout each coil portion.

In yet another aspect, the invention is a method for producing a superconducting coil assembly. The method involves assembling a stack by disposing on an insulating substrate a plurality of insulating layers in a stacked assembly on the substrate. Each insulating layer has a via therethrough. A superconducting coil portion is disposed on the substrate and each except the uppermost of the insulating layers, prior to or during said assembling step. Each superconducting coil portion consists essentially of a thick film of a high temperature ceramic superconducting material, and is disposed as a spiral pattern of at least one winding and having a first end and a second end. Each of the first ends except that of the coil portion disposed on the substrate is superconductively connected, during or after the assembling step, to the second end of an adjacent coil portion so that the plurality of coil portions are joined to form a continuous superconducting coil assembly of right hand or left hand orientation.

BRIEF DESCRIPTION OF THE DRAWINGS

For a better understanding of the present invention, together with other objects, advantages and capabilities thereof, reference is made to the following Description and appended Claims, together with the Drawings, in which:

DETAILED DESCRIPTION OF THE PREFERRED EMBODIMENTS

The assembly described herein presents to the art a thick film alternative to using wires for making superconducting coils. Typically, the term "thick film" is used in the art to refer to films 2–250 μm in thickness, with the higher portion of this range preferred over the lower portion for superconducting films. The assembly described herein eliminates the problems of (a) bending the brittle superconducting ceramic materials and (b) their mechanical stability under assembly and use conditions.

In an illustrative assembly, a superconducting spiral is formed on each of a group of flat substrates using thick film methods. A plurality of such spiral patterned substrates are stacked, alternating inward and outward spiralling patterns and interconnecting the patterns, in a sufficient number to form a coil assembly with the desired large number of turns or windings.

The substrate material may be any rigid nonsuperconducting material exhibiting no detrimental chemical reactivity with the superconductor material to be deposited thereon. Ceramic materials are preferred for the substrates, but other materials meeting the above requirement may be used. Examples of suitable substrates for a wide range of superconductor materials are oxides containing Be, Mg, Ca, Sr, Ba, Sc, Y, La, Ti, and/or Zr. These materials may make up the entire thickness of the layer, or may be utilized as adherent coatings on other substrate materials.

The superconducting coils may be formed from any high $T_c$ oxide superconducting materials such as yttrium (or rare earth) barium copper oxide, bismuth strontium calcium copper oxides, thallium strontium calcium copper oxides, and bismuth-lead strontium calcium copper oxides.

Figure 1:
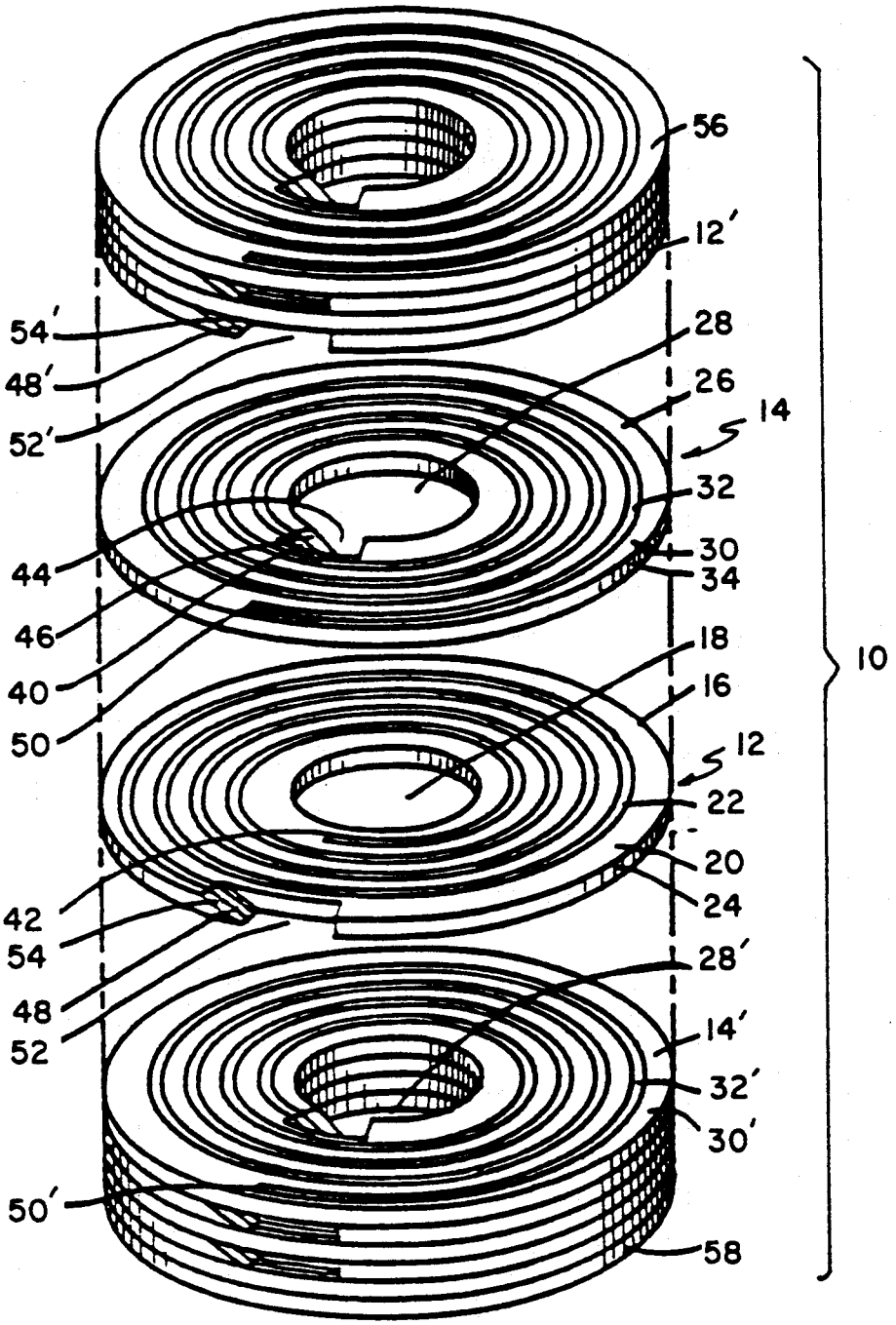
FIG. 1 is an exploded schematic perspective view of a superconducting coil assembly in accordance with one embodiment of the invention, made with multiple layers of thick film superconductor in spiral form.

One such coil assembly is illustrated schematically in FIG. 1. In coil assembly 10, layers 12 and 14 are stacked alternately to form the coil. Layer 12 is washer-like, having generally circular non-superconducting substrate body 16 with axial hole 18 through the center. Top surface 20 of substrate 16 carries superconducting spiral pattern 22 which begins near outer edge 24 and spirals inwardly in a clockwise direction approaching hole 18.

Similarly, layer 14 is also washer-like, having generally circular non-superconducting substrate body 26 with axial hole 28 through the center. Conveniently, substrate bodies 16 and 26 are of the same material. Planar upper surface 30 of substrate body 26 carries superconducting spiral pattern 32 which begins near hole 28 and spirals outwardly in a clockwise direction approaching outer edge 34. Layers 12 and 14 are generally planar and of uniform thickness, and are sufficiently similar in size and shape to assemble by superimposing one on another with holes 18 and 28 and outer edges 24 and 34 aligned to form cylindrical assembly 10. The thickness of substrate bodies 16 and 26 is sufficient to provide an electrical insulating layer to prevent shorting between spiral patterns, e.g. patterns 22 and 32.

Each superconducting spiral pattern is interconnected with a corresponding pattern, radially reversed relative to a common circumferential direction, on adjacent layers above and below, alternating interconnections between inner and outer ends of the spirals to form a continuous superconducting path spiralling between the outermost layers. In the embodiment illustrated in FIG. 1, spiral pattern 32 of layer 14 is interconnected with spiral pattern 22 of layer 12 at inner spiral pattern ends 40 and 42 respectively. To provide contact between pattern ends 40 and 42, via 44 defining ramp 46 is formed at hole 28 in substrate 26 by molting, machining, or the like. Ramp 46 carrying spiral pattern end 40 extends downward through the entire thickness of layer 14 to a position where, on assembly of layers 12 and 14, end 40 is in contact with layer 12. Correspondingly, spiral pattern end 42 extends to contact end 40, on assembly of layers 12 and 14, to form a continuous superconducting path extending from near outer edge 24 on top surface 20 to near outer edge 34 on top surface 30.

Similarly, spiral pattern 22 of layer 12 is interconnected with spiral pattern 32′ of layer 14′ at spiral pattern ends 48 and 50′ respectively. Layer 14′ may advantageously be identical in configuration to layer 14. Via 52 defining ramp 54 is formed in substrate 16 at outer edge 24. Ramp 54 carrying spiral pattern end 48 extends downward through the entire thickness of layer 12 to a position where, on assembly of layers 12 and 14′, end 48 is in contact with layer 14′. Correspondingly, spiral pattern end 50′ extends to contact end 48, on assembly of layers 12, 14, and 14′, to form a continuous superconducting path extending from near axial hole 28′ on top surface 30′ to near outer edge 34 on top surface 30. In the same manner, spiral pattern end 50 of layer 14 contacts spiral end 48′ on ramp 54′ at via 52′ of layer 12′ to continue the continuous superconducting path from top surface 30 to the spiral pattern (not shown) on the top surface (not shown) of layer 12′. Layer 12′ may advantageously be identical in configuration to layer 12.

Additional windings are added by stacking additional layers above layer 12′ and/or below layer 14′ to form a complete coil. Layers identical to layer 12 and layers identical to layer 14 may be alternated and interconnected as described above. The number of turns in each spiral pattern and the number of layers in coil assembly 10 determine the number of windings in the coil.

To complete the superconducting circuit, end terminals may be provided at the beginning and end of the superconducting path through the coil assembly. One means of completing the superconducting circuit to form a closed loop is illustrated schematically in FIG. 2. End terminals 202 and 204 are formed integral to uppermost substrate 256 and lowermost substrate 258 respectively of assembly 200, each end terminal being in the form of a protruding beveled portion of the substrate. Superconducting pattern 222 (superconductively joined to the upper end of coil 232) extends from uppermost substrate 256 onto exposed region 206 of end terminal 202, thereby forming contact portion 208. Terminal 204 is similarly formed at the opposite, lower end of coil 232, with exposed region 210 and contact portion 212. End terminals 202 and 204 are then interconnected by means of link 214 which has beveled ends 216 and 218 complementary to beveled end terminals 202 and 204 respectively. Link 214 has continuous superconducting coating layer 220 coated on its inner surface and extending onto beveled surfaces 216 and 218 to form contact portions 224 and 226. Link 214 is sintered to assembly 200 to join link coating 220 with pattern 222 and coil 232 along the mating interfaces of contact portions 224 and 208 and contact portions 226 and 212 Link 214 may be sintered to assembly 200 using any of the processes known in the art which will maintain the superconducting qualities of link coating 220, pattern 222, and coil 232, i.e. heated in air or an oxidizing atmosphere to temperatures greater than about 800° C. Assembly 200 is illustrated in FIG. 3 in a perspective view showing link 214 sintered thereon to form a continuous superconductive loop. (In FIGS. 2 and 3 like features are designated by like reference numerals.) Such a continuous superconductive loop allows the establishment of a persistent current, and is useful in electromagnets.

The uppermost and/or lowermost layers may provide the outer surfaces of the assembly, as shown at uppermost layers 56 and 256. Alternatively, an additional protective, non-superconducting layer may be provided to cap one or both outer surfaces, as shown at lowermost layer 58 of FIG. 1. Uppermost layer 256 and layer 234 adjacent thereto may be mated with their patterns face to face, as described below. Alternatively, the layer adjacent uppermost layer 256 may advantageously be an insulating blank, providing a superconducting link between spiral patterns but otherwise preventing contact between facing spiral patterns. Similarly, such a linking blank may be provided elsewhere in the assembly to serve the same purpose. In another alternative, one or both of the facing spiral patterns may have an outer coating of thick film insulation. The spiral patterns on the adjacent disks are interconnected by such means as open areas in the insulating film, short superconducting connecting strips printed on vias through the insulating layers, or separate superconducting connectors applied to the cylindrical outer surface of the assembly.

In an alternative arrangement, a single substrate has layers of thick film superconducting spiral patterns coated on both sides, connected by vias. These layers may alternate with insulating layers or may have an outer coating of thick film insulation, similar to that described above, on one or both sides. The spiral patterns on separate disks are interconnected by means similar to those described above for connecting facing spiral patterns.

The thick superconducting films forming the spiral patterns on each layer may be produced by known means. For example, the patterns may be screen printed on single crystal or polycrystalline substrates, and converted to the superconducting phase using laser processing, as described in commonly owned U.S. Pat. No. 5,015,618. An illustrative laser processing method involves passing the beam of an argon laser spirally lengthwise over the screen-printed, dried thick film of the spiral patterns. The spiral pattern is progressively zone-melted through its entire thickness and across its width, then resolidified, as the translating beam reaches each cross-sectional portion of the deposited film and subsequently passes beyond that portion. The microstructure of the screen-printed material changes on resolidification, i.e. the material becomes fully dense and the grains recrystallize in an elongated form and aligned generally parallel to the direction of movement of the beam. This microstructural texturing improves the superconducting properties of the thick film, particularly the critical current density. Processing such materials in a circular or spiral pattern may be performed by adapting this technology in known manner, e.g. using servo motor control of the laser beam. A maximum $J_c$ of about 2000 A/cm$^2$ at a temperature of 77° K and 11,200 A/cm$^2$ at 60° K has been obtained at ambient magnetic field by the process described in U.S. Pat. No. 5,015,618, which is incorporated herein by reference.

One production consideration in producing coils which are structured from flat patterns as described above is laminating together or otherwise forming in place the successive substrates in such a manner as to make the above-described layer-to-layer transitions or contacts possible. In one embodiment, this requirement may be met by providing, for example, multiple preprinted substrates with ramps at the end points of the spiral patterns as illustrated in FIG. 1. Such ramped substrates may be installed and bonded to one another as the heat treatment, e.g. laser treatment, process progresses along the pattern without interrupting the cycle or the speed of the process. Thus no joint, per se, is actually made, or necessary. With such a process, substrates whose interconnection ramps are positioned at the axial hole may be pre-installed in the equipment by threading these disks over the heat treating "head" so that they may be singly positioned in the assembly without interruption or blocking of the localized heat-treatment process. The remaining, alternating substrates may be positioned in known manner for placement singly in the assembly, e.g. using equipment of the type known in the electronics assembly art.

In a second embodiment, each spiral pattern section of the total coil, on its washer-shaped disk, is pre-heat treated to create a superconducting section. Each section is subsequently joined to another section by localized heat treatment, thus effecting a "weldment". This is a simplified process, eliminating the need for maintaining an uninterrupted heat treating process through the complicated cycles of rotation, insertion, bonding, etc of successive discs. Locally increased width and/or thickness of the conducting spiral end regions may be provided for maintaining superconducting performance by compensating for any tendency toward lower $J_c$ in the welded joints. In certain instances, this alternate process may require deposition, on the pre-heat treated layers, of additional ceramic or pre-ceramic material to be heat treated to form the superconducting bond.

Figure 2:
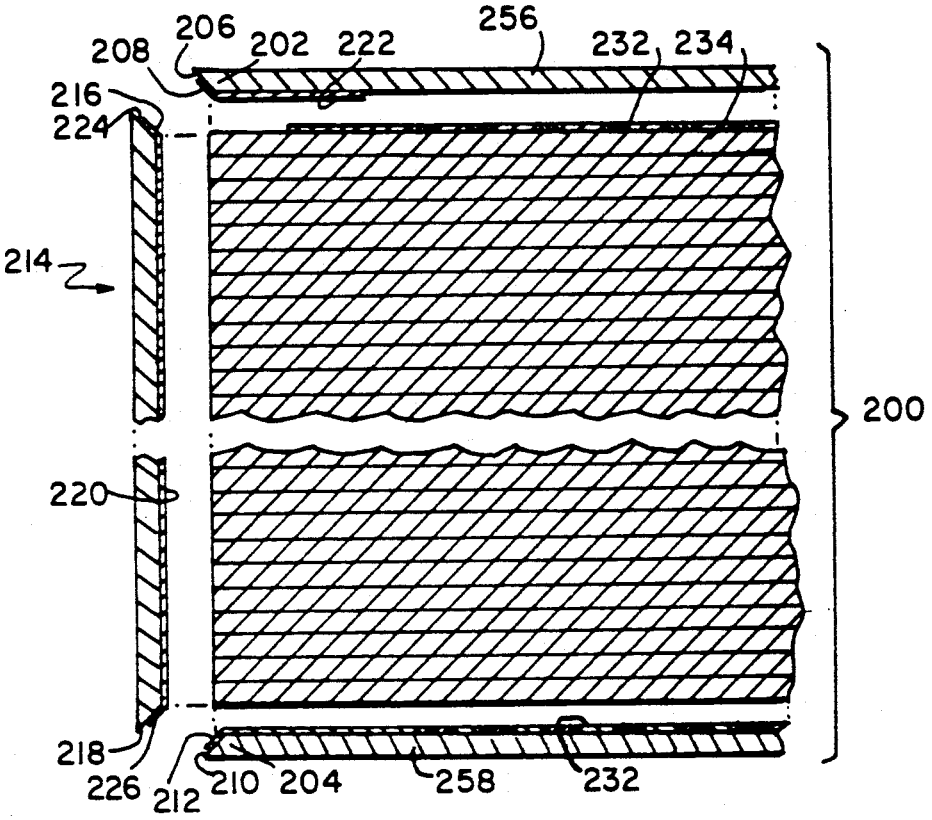
FIG. 2 is an exploded schematic elevation view of one embodiment of a sinterable link for connecting, in this embodiment, two nonadjacent layers of a superconducting coil assembly, shown with an assembly similar to that shown in FIG. 1.
Figure 3:
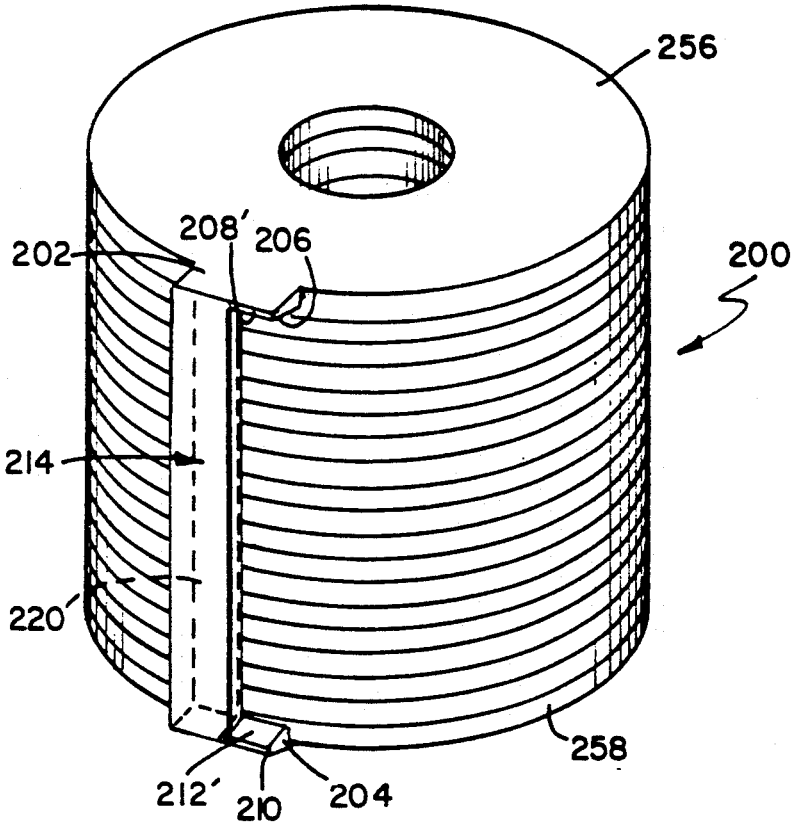
FIG. 3 is a perspective view of the link and assembly of FIG. 2, in which the superconductive circuit of the assembly is closed on itself with the sinterable link, thereby forming a loop.

In a third embodiment, two superconducting patterns are mated face to face and bonded with a sintering process, for example as shown in FIG. 2 where pattern 222 on layer 256 overlaps and is superconductively bonded to (e.g. by sintering) the upper end of coil 232 on layer 234 to interconnect the superconducting coil to coating layer 220 of link 214.

In another, preferred, embodiment, as described above, a single substrate is provided which supports a number of alternating layers of superconducting spiral patterns and nonsuperconducting coating material, both of which are, e.g., screen printed in situ. This process may be described as effectively creating each successive disc and spiral pattern section, similar to those illustrated in FIGS. 1, 2, and 3, in situ rather than stacking pre-prepared patterned discs. This alternative presents the advantages of high packing density and relatively inexpensive processing. This single substrate alternative, however, requires application of the insulating layers in such a way that the general planarity of the successive coatings is maintained. This may be accomplished in each individual insulating layer by such methods as spinning of the assembly to flow a coating/binder mixture into the gaps between the turns of the spiral pattern or reflow of a glass insulation material. Alternatively, the coatings may be replanarized, individually or periodically as they become excessively uneven, by such means as lapping and/or polishing.

In yet another alternative, a nonsuperconducting oxide ceramic substrate of similar composition to a high temperature ceramic superconductor material may be heat treated, e.g. laser treated, only along the track of a desired spiral pattern to create, in situ, the desired superconducting spiral pattern. Any of the above-described methods of joining the patterns on successive layers which would maintain the distinction between superconducting and nonsuperconducting portions may then be used to produce a coil with the desired number of windings. Of particular advantage is the continuous heat treatment, e.g. laser treatment, method described above, using vias and ramps, since both the spiral patterns and the "joints" are created in situ. Alternatively, other embodiments not described herein are also within the scope of the invention.

The assemblies described herein also present a unique advantage in that any of the above-described alternatives may be adapted to overcome a problem encountered in electromagnets utilizing high temperature superconducting materials. All superconductors suffer a reduction of critical current density when subjected to a magnetic field. This effect has been found to be particularly strong in the new high temperature superconductors. Superconducting materials used in electromagnets are unavoidably exposed to magnetic fields. Typically, a design compromise is made whereby the current flowing in the conductors is adjusted to be less than the critical current at the operating field. However, the local field around each winding of such a magnet depends on its depth in the coil, with the outermost windings exposed to the smallest magnetic field and the innermost ones to the greatest. The geometry of the assemblies described herein permits a unique approach to the problem, taking advantage of this variation in magnetic field. The cross-sectional area, i.e. the width and/or thickness, of the superconducting spiral patterns may be gradually and continuously varied to be greater near the center of the coil than at the edges. This increase of spiral pattern cross-sectional area in the region of greatest magnetic field compensates for the local reduction in critical current density. Thus the total critical current is approximately constant at each point along the spiral pattern. Additionally, the number of windings placed in the available area may be maximized, since the outer turns may be of lesser width. Such variations in cross-sectional area may be effected by means known in the screen printing art, e.g. by appropriate design of the screen printing mask.

In coils where the end terminals of the assembly are connected to one another, for example as shown in FIGS. 2 and 3, the end terminals may be connected to an external electrical circuit utilizing an exposed region of the superconducting pattern. FIG. 3 illustrates exposed superconducting contacts 208' and 212' on portions of exposed regions 206 and 210, respectively, adjacent to and not covered by link 214. Contacts 208' and 212' are extensions of pattern 222 and coil 232, and superconductively communicate therewith. Contacts 208' and 212' are provided for temporary connection to an external current source for introducing the startup current. As with any superconducting coil, the startup current must be introduced in such a manner that it passes through coil 232 without shorting through superconducting layer 220 on the inner surface of link 214. To this end, the return path provided by layer 220 may be rendered temporarily non-superconducting by, e.g., application to the link of a magnetic field or localized heating.

The following Examples are presented to enable those skilled in the art to more clearly understand and practice the present invention. These Examples should not be considered as a limitation upon the scope of the present invention, but merely as being illustrative and representative thereof.

EXAMPLE 1

Fabrication of a Superconducting Coil of 1200 Windings Using Prefabricated Ceramic Disks:

Two groups of polycrystalline MgO disk-shaped substrates, 5 cm diameter×0.8 cm thick and having a 1.5 cm diameter axial hole therethrough, are molded and machined to create a single ramped via through each disk. The vias are positioned in Group A at the inner, axial hole edge and in Group B at the outer edge, as shown in FIG. 1. Each via is about 2 mm×2 mm at the lower planar surface of the substrate and is ramped upward in a clockwise direction at an angle of 20° to the upper planar surface. The ramps and surfaces of the substrates are polished using a diamond paste.

Group C (lower) and Group D (upper) capping disks are prepared in the same manner of the same material, diameter, thickness, and hole configuration, but substituting a protrusion about 2 mm (radial)×1.5 cm (circumferential) at the outer edge of each disk for the via. Each protrusion is machined to provide a ramp extending downward in an outward direction from the outer edge at a planar deposition surface to the outer edge of the protrusion.

Two small notches are machined into the periphery of each disk, 90° apart and symmetrical about the vias or protrusions, to aid in accurate registration of each disk during subsequent processing. A screen printing paste of bismuth strontium calcium copper oxide in an organic binder is prepared by ball milling the precursor bismuth oxide, strontium carbonate, calcium carbonate, and copper oxide powders in molar proportions Bi:Sr:Ca:Cu of 2:2:2:3, calcining the resulting powder mixture at 830° C. for 12 hr, ball milling the calcined powders, and repeating the calcining procedure. The prepared powders are screened to isolate the 325 mesh portion and mixed with a commercial organic binder (#400 vehicle, Electro-Science Laboratories, King of Prussia, Pa.).

Using the edge notches to accurately position the disks, masks defining spiral patterns are superimposed over the disks, and a thick film pattern of the paste, 12 turns about 1 mm wide, is screen printed onto the polished planar surface of each substrate. The substrates are heated to 300° C. for a time sufficient to dry the paste. In a separate screen printing step, a thick film strip of the same material is then similarly printed and dried to extend down the full length of the ramp of the substrate via or protrusion to form a continuous strip with the spiral pattern on the planar substrate surface. The average dry thickness of each spiral strip is about 20 μm. Each Group A substrate receives a clockwise spiral pattern running from the via ramp at the inner edge to a point in line with but extending about 2 mm beyond the point at which the bottom of the ramp of a superimposed Group B disk would contact the strip. Similarly, each Group B substrate receives a clockwise spiral pattern running from the via ramp at the outer edge to a point in line with but extending about 2 mm beyond the point at which the bottom of the ramp of a superimposed Group A disk would contact the strip. Also similarly, each Group C and Group D substrate receives a clockwise spiral pattern running from the ramp on the protrusion at the outer edge to a point in line with but extending about 2 mm beyond the point at which the bottom of the ramp of a superimposed Group A disk would contact the strip. Additionally, each Group C and Group D disk receives a contact pad and an additional strip of the same material on the protrusion ramp adjacent to and connecting with the ramp portion of the spiral pattern. Up to this point the preparation of Group C and Group D disks is identical.

Once each strip is dry it is subjected to a zone-melting heat treatment process in air. An Ar ion laser is used to move a molten zone along the length of the strip, with the substrate positioned using the edge notches on an enclosed hot stage at about 700° C., converting the screen printed powder to a high $J_c$ superconducting material. The process is generally similar to that described in above-mentioned application Ser. No. 07/423,998. The laser beam, at 2.2 W, is focused by a cylindrical lens to an ellipse of about 2 mm (major axis) by about 0.1 mm, and is moved at a constant speed of about 1 cm/hr along each spiral pattern, from its inner end to its outer end, including the portion along each ramp, with the major axis of the beam across the width of the strip. The movement of the beam along the spiral pattern is automated through servo control of the radial movement of the heat treating laser combined with servo control of rotation of the hot stage.

A series of 98 disks is assembled, alternating a Group A and a Group B disk in a manner similar to that shown in FIG. 1, by the following procedure. Each end of each spiral pattern is built up in both width and thickness by the application and drying of additional screen printing paste. A Group B disk is superimposed over a Group A disk with their edges precisely aligned. By using the edge notches on each disk, the spiral pattern end at the bottom of the via ramp of the Group B disk is positioned in precise register with the spiral pattern, about 2 mm from its end, on the planar surface of the Group A disk to provide maximum physical contact between the respective spiral pattern ends. A second Group A disk is then superimposed over the Group B disk in the same manner, and so on, repeating the process until all of the disks are assembled with a Group A disk at the bottom and a Group B disk at the top of the assembly, providing 1176 turns. The assembly is then annealed and sintered at 850° C. for 12 hr. A bonded joint is created between adjacent disks during the annealing process using a suitable sintering agent. A superconductive "welded" bond is formed at the contact points of the built up spiral pattern ends by the sintering/annealing process.

The uppermost disk, a Group B disk, is then coated with an insulating layer as follows. A layer of MgO insulating material is screen printed over the entire surface of the disk, except for a 2 mm×2 mm opening exposing the spiral pattern's built up inner end to a point about 2 mm from the end for electrical contact to a subsequent spiral pattern.

The assembly is then capped at each end, at the bottom with a Group C disk and at the top with a Group D disk, with the spiral pattern of each facing inwardly toward a Group A and a Group B disk respectively, with their edges precisely aligned and using the edge notches for precise registration. The built up spiral pattern end on the planar surface of the Group D disk is in precise register with the exposed built up end of the uppermost Group B disk through the insulating layer to provide maximum contact between the respective spiral pattern ends during subsequent heating/annealing. The built up spiral pattern end at the bottom of the via ramp of the lowermost Group A disk is in precise register with the built up spiral pattern on the planar surface of the Group C disk, about 2 mm from its inner end, to provide maximum physical contact between the respective spiral pattern ends. The assembly is then sintered/annealed at 850° C. in air for 12 hr to create a bonded joint between adjacent disks, to provide a superconductive "welded" bond at the contact points of the spiral pattern ends, and to anneal the superconducting portions of the assembly for maximum $J_c$.

EXAMPLE 2

Fabrication of a Superconducting Coil of 1200 Windings with Deposition of Nonsuperconducting Layers:

A first spiral pattern of bismuth strontium calcium copper oxide superconducting material in molar proportions of Bi:Sr:Ca:Cu of 2:2:2:3 is produced on a single substrate of single crystal magnesium oxide by screen printing and laser treatment as described above for Example 1. The substrate is of the same geometry as described for Group C of Example 1. The spiral pattern winds counterclockwise from near the outer edge to near the inner edge of the substrate. A mask bearing a negative image of this screened conductive pattern is located in precise register with the conductive pattern, and a layer MgO insulating material of the same thickness as the conductive material is deposited onto the substrate between turns of the spiral pattern to reestablish an approximately planar surface.

An approximately 20 μm thick layer of the same insulating material is then screen printed over the entire surface except for the inner end of the spiral pattern, which is left exposed for electrical contact to the subsequent spiral pattern in the manner described above for the uppermost Group B disk of Example 1. This exposed end is then built up with an additional amount of the same superconducting material to a depth slightly greater than the thickness of the insulating layer. The assembly is then sintered at 850° C. in air for 12 hr.

A second spiral pattern similar to the first, but of opposite sense so that it spirals counterclockwise outwardly instead of inwardly, is produced as described above on the insulating layer, its inner end in precise register with and overlapping the exposed and built up inner end of the previously printed spiral pattern. The surface is masked and filled to reestablish a planar surface, a new insulating layer deposited, the outer end of the spiral pattern is built up, and the assembly is sintered, all as described above.

This sequence of applying alternating sensed patterns interspersed with insulating layers, followed by heat treatment continues until such time as the layers become excessively uneven, in this case, about every 20 layers. Replanarizing is accomplished as necessary by applying extra layers of insulation, lapping the surface for flatness, then applying a final thin layer of insulation to assure that adequate insulation remains over the entire surface. The non-contacted built up end of the uppermost spiral pattern is protected throughout and subsequently again built up if necessary for adequate electrical contact to the subsequent spiral pattern. Then application of superconducting patterns resumes as described for the initial layers. This process continues until a coil of 1188 windings is achieved. The assembly is then capped at the top with a Group D disk and given a final annealing as described above for Example 1, resulting in a total of 1200 windings.

The superconducting coil assembly and method described herein presents many advantages over known coils. For example, this assembly avoids problems with brittleness of wires during assembly of the coil. It also reduces problems associated with the typically low mechanical strength of ceramic superconductors, especially when the large magnetic fields induced during use stress the conductors. Also, the substrates may be constructed of polycrystalline or single crystal MgO or other chemically and mechanically compatible rigid material, or compatible buffer layers may be used on non-compatible substrates, to reduce the cost of such an assembly. The relatively high packing density which may be achieved is an advantage as well. Further, as described above, portions of the coil itself may readily be varied in cross-sectional area to compensate for magnetic field-induced degradation of the critical current capacity.

While there has been shown and described what are at present considered the preferred embodiments of the invention, it will be obvious to those skilled in the art that various changes and modifications can be made therein without departing from the scope of the invention as defined by the appended Claims.

We claim:

1. A superconducting coil assembly comprising:

a rigid, generally planar insulating substrate;

a plurality of generally planar insulating layers disposed in a stacked assembly on said substrate;

a plurality of superconducting coil portions each consisting essentially of a thick film of a high temperature ceramic superconducting material and each having a first end and a second end, wherein a first of said coil portions is disposed at an interface between said substrate and said insulating layer adjacent thereto and the remainder of said coil portions are each disposed at an interface between adjacent pairs of said insulating layers, said coils each lying generally within and generally defining a plane; and a superconducting connecting portion, consisting essentially of a thick film of the same superconducting material as that of said coil portions, connecting each of said first ends except that of said first coil portion to said second end of an adjacent one of said coil portions so that said plurality of coil portions are joined by said connecting portions to form a continuous thick film superconducting coil of right hand or left hand orientation.

2. A superconducting coil assembly in accordance with claim 1 wherein:

each of said coil portions is a spiral pattern of at least one winding; and inwardly spiralling coil portions alternate with outwardly spiralling coil portions.

3. A superconducting coil assembly in accordance with claim 2 wherein:

each of said coil portions is connected to at least one other of said coil portions by way of a via through an intervening one of said insulating layers; and said connecting portions are disposed at said vias.

4. A superconducting coil assembly in accordance with claim 3 wherein:

each of said insulating layers is in the form of an annular disk having a central opening and an outer edge;

each of said coil portions extends from near said outer edge to near said central opening; and said connecting portions are disposed alternately near said outer edge and near said central opening so that said plurality of coil portions are joined by said connecting portions to form said continuous superconducting coil.

5. A superconducting coil assembly in accordance with claim 4 wherein each of said coil portions is of a greater cross-sectional area near said central opening than near said outer edge.

6. A superconducting coil assembly in accordance with claim 5 wherein said cross-sectional area of each of said coil portions varies approximately inversely with its radius to effect an approximately constant critical current capacity throughout each of said coil portions.

7. A superconducting coil assembly comprising:

an insulating substrate;

a plurality of insulating layers disposed in a stacked assembly on said substrate;

a plurality of superconducting coil portions each consisting essentially of a thick film of a high temperature ceramic superconducting material and each having a first end and a second end, wherein a first of said coil portions is disposed between said substrate and said insulating layer adjacent thereto and the remainder of said coil portions are each disposed between adjacent pairs of said insulating layers;

a superconducting connecting portion, consisting essentially of a thick film of the same superconducting material as that of said coil portions, connecting each of said first ends except that of said first coil portion to said second end of an adjacent one of said coil portions so that said plurality of coil portions are joined by said connecting portions to form a continuous thick film superconducting coil of right hand or left hand orientation; and contact means for connecting said continuous superconducting coil to an electrical circuit.

8. A superconducting coil assembly in accordance with claim 7 further comprising a superconducting connecting link consisting essentially of a thick film of the same superconducting material as that of the coil portions, connected to said continuous superconducting coil to form a closed loop, such that current initially introduced to said coil by means of said electrical circuit and said contact means continuously flows within said closed loop with no resistance when said coil is cooled to an appropriate temperature.

9. A superconducting coil assembly in accordance with claim 1 further comprising:

an additional superconducting coil portion consisting essentially of a thick film of the same superconducting material as that of said coil portions and having a first end and a second end, and disposed on an uppermost of said insulating layers; and an additional superconducting connecting portion, consisting essentially of a thick film of the same superconducting material as that of said coil portions, connecting said first end of said additional coil portion to said second end of the one of said coil portions disposed between said uppermost insulating layer and the one of said insulating layers adjacent thereto.

10. A superconducting coil assembly comprising:

an insulating substrate having a first contact means;

a plurality of insulating layers disposed in a stacked assembly on said substrate, wherein each of said insulating layers is in the form of an annular disk having a central opening, an outer edge, and a via therethrough, the vias of successive ones of said insulating layers disposed alternately near said outer edge and near said central opening;

a plurality of superconducting coil portions each consisting essentially of a thick film of a high temperature ceramic superconducting material and each having a first end and a second end, wherein a first of said coil portions is disposed between said substrate and said insulating layer adjacent thereto and the remainder of said coil portions are each disposed between adjacent pairs of said insulating layers, and wherein each of said coil portions is a spiral pattern of at least one winding extending between said vias of said insulating layers above and below said coil portion, or in the case of said first coil portion, between said via of said insulating layer above said first coil portion and said first contact means, inwardly spiralling coil portions alternating with outwardly spiralling coil portions;

a superconducting connecting portion, consisting essentially of a thick film of the same superconducting material as that of said coil portions, disposed at each of said vias and connecting each of said first ends except that of the first coil portion to said second end of an adjacent one of said coil portions so that said plurality of coil portions are joined by said connecting portions to form a continuous superconducting coil of right hand or left hand orientation;

a second contact means connected to said second end of the uppermost of said coil portions; and a superconducting connecting link, consisting essentially of a thick film of the same superconducting material as that of said coil portions, interconnecting said first contact means and said second contact means to form a closed loop with said continuous superconducting coil, such that current initially introduced to said coil continuously flows within said closed loop with no resistance when said coil is cooled to an appropriate temperature.

11. A superconducting coil assembly in accordance with claim 10 wherein the cross-sectional area of each of said coil portions varies approximately inversely with the radius of said coil portion to effect an approximately constant critical current capacity throughout each of said coil portions.

12. A method for producing a superconducting coil assembly comprising the steps of:

screen printing on each of an insulating substrate and a plurality of insulating layers a thick film of a paste of a material selected from the group consisting of a high temperature ceramic superconducting material and precursors thereof deposited as a spiral pattern of at least one winding and having a first end and a second end;

assembling a stack by disposing on said insulating substrate said plurality of insulating layers in a stacked assembly;

heat treating said substrate and said insulating layers, prior to or during said assembling step, to convert said paste to a superconducting ceramic phase; and superconductively connecting, during or after said assembling step, each of said first ends except that of said spiral pattern deposited on said substrate to said second end of an adjacent one of said spiral patterns so that said plurality of spiral patterns are joined to form a continuous superconducting coil assembly of right hand or left hand orientation;

wherein said screen printing step includes varying the cross sectional area of each of said spiral patterns approximately inversely with the radius of said spiral pattern to effect an approximately constant critical current capacity throughout each of said spiral patterns.

13. A superconducting coil assembly in accordance with claim 1 wherein said coil portion thick film and said connecting portion thick film are screen-print films about 2–250 μm thick.

14. A superconducting coil assembly in accordance with claim 1 wherein said coil portions exhibit alignment of elongated grains within said thick film.

15. A method for producing a superconducting coil assembly comprising the steps of:

screen printing on each of a rigid, generally planar insulating substrate and a plurality of generally planar insulating layers a thick film of a paste of a material selected from the group consisting of a high temperature ceramic superconducting material and precursors thereof deposited as a spiral pattern of at least one winding and having a first end and a second end, such that each of said spiral patterns lies generally within and generally defines a plane;

assembling a stack by disposing on said insulating substrate said plurality of insulating layers in a stacked assembly in which one of said spiral patterns is disposed at an interface between said substrate and said insulating layer adjacent thereto and the remainder of said spiral patterns are each disposed at an interface between adjacent pairs of said insulating layers;

heat treating said substrate and said insulating layers, prior to or during said assembling step, to convert said paste to a superconducting ceramic phase; and superconductively connecting, during or after said assembling step, each of said first ends except that of said spiral pattern deposited on said substrate to said second end of an adjacent one of said spiral patterns so that said plurality of spiral patterns are joined to form a continuous superconducting coil assembly of right hand or left hand orientation.

16. A method in accordance with claim 15 further comprising the step of texturing said thick films, prior to or during said assembling step, to produce alignment of elongated grains within said thick films.

17. A method for producing a superconducting coil assembly comprising the steps of:

assembling a stack by depositing on a rigid, generally planar insulating substrate a plurality of intermediate, generally planar insulating layers in a stacked assembly and capping said stack by depositing a final insulating layer;

screen printing on each of said insulating substrate and said plurality of intermediate insulating layers, during the assembling step and before deposition of the next-deposited of said insulating layers, a thick film of a paste of a material selected from the group consisting of a high temperature ceramic superconducting material and precursors thereof deposited as a spiral pattern of at least one winding and having a first end and a second end, such that each of said spiral patterns lies generally within and generally defines a plane, and such that one of said spiral patterns is disposed at an interface between said substrate and said insulating layer adjacent thereto and the remainder of said spiral patterns are each disposed at an interface between adjacent pairs of said insulating layers;

heat treating said substrate and said insulating layers, prior to or during said assembling step, to convert said paste to a superconducting ceramic phase; and superconductively connecting, during or after said assembling step, each of said first ends except that of said spiral pattern deposited on said substrate to said second end of an adjacent one of said spiral patterns so that said plurality of spiral patterns are joined to form a continuous superconducting coil assembly of right hand or left hand orientation.

18. A method for producing a superconducting coil assembly comprising the steps of:

assembling a stack by depositing on an insulating substrate a plurality of intermediate insulating layers in a stacked assembly and capping said stack by depositing a final insulating layer;

screen printing on each of said insulating substrate and said plurality of intermediate insulating layers, during the assembling step and before deposition of the next-deposited of said insulating layers, a thick film of a paste of a material selected from the group consisting of a high temperature ceramic superconducting material and precursors thereof deposited as a spiral pattern of at least one winding and having a first end and a second end;

heat treating said substrate and said insulating layers, prior to or during said assembling step, to convert said paste to a superconducting ceramic phase; and superconductively connecting, during or after said assembling step, each of said first ends except that of said spiral pattern deposited on said substrate to said second end of an adjacent one of said spiral patterns so that said plurality of spiral patterns are joined to form a continuous superconducting coil assembly of right hand or left hand orientation;

wherein said screen printing step includes varying the cross sectional area of each of said spiral patterns approximately inversely with the radius of said spiral pattern to effect an approximately constant critical current capacity throughout each of said spiral patterns.

19. A method in accordance with claim 17 wherein said assembling step comprises depositing said intermediate insulating layers and said final insulating layer by chemical or physical vapor deposition.

20. A method in accordance with claim 17 further comprising the step of texturing said thick films, prior to or during said assembling step, to product alignment of elongated grains within said thick films.

* * * * *